US011214477B2

(12) United States Patent
Nishimura

(10) Patent No.: US 11,214,477 B2
(45) Date of Patent: Jan. 4, 2022

(54) COCK FOR CARBONATED WATER

(71) Applicant: Suntory Holdings Limited, Osaka (JP)

(72) Inventor: Naoki Nishimura, Kawasaki (JP)

(73) Assignee: SUNTORY HOLDINGS LIMITED, Osaka (JP)

( * ) Notice: Subject to any disclaimer, the term of this patent is extended or adjusted under 35 U.S.C. 154(b) by 0 days.

(21) Appl. No.: 16/469,722

(22) PCT Filed: Dec. 7, 2017

(86) PCT No.: PCT/JP2017/044083
§ 371 (c)(1),
(2) Date: Jun. 14, 2019

(87) PCT Pub. No.: WO2018/110436
PCT Pub. Date: Jun. 21, 2018

(65) Prior Publication Data

US 2020/0079638 A1 Mar. 12, 2020

(30) Foreign Application Priority Data

Dec. 16, 2016 (JP) ..... JP2016-244754

(51) Int. Cl.
*B67D 1/12* (2006.01)

(52) U.S. Cl.
CPC ..... *B67D 1/1277* (2013.01)

(58) Field of Classification Search
CPC .. B67D 1/1277; B67D 1/0068; B67D 1/0035; B67D 1/005; B67D 1/14; B67D 1/12; B67D 1/1455; B67D 1/0406
See application file for complete search history.

(56) References Cited

U.S. PATENT DOCUMENTS 2,526,331 A * 10/1950 Copping ..... G01F 11/086 222/129.2
2,537,119 A * 1/1951 Bauerlein ..... B67D 1/0052 137/594

(Continued)

FOREIGN PATENT DOCUMENTS

DE 29704998 U1 5/1997
EP 2703336 A1 3/2014

(Continued)

*Primary Examiner* — Frederick C Nicolas
*Assistant Examiner* — Randall A Gruby
(74) *Attorney, Agent, or Firm* — Westerman, Hattori, Daniels & Adrian, LLP

(57) ABSTRACT

A cock (10) that receives and discharges the carbonated water from a nozzle (70) includes: a first flow path (4S); and a second flow path (46). A flow path transverse Closs-section has an annular shape. The second flow path has an outer diameter larger than that of the first flow path and having a flow path cross-sectional area smaller than that of the first flow path; and a shaft (50) which forms the inner circumferential surface of the second flow path. the shaft having a ring-shaped groove (52) formed over the outer circumference of the shaft in a part of the second flow path that is connected to the first flow path, wherein a longitudinal center axis line (C1) of the first flow path is nonparallel to and does not intersect with a longitudinal center axis line (C2) of the second flow path.

2 Claims, 6 Drawing Sheets

(56) References Cited

U.S. PATENT DOCUMENTS 3,800,826 A * 4/1974 McCann ..... B67D 1/005 137/560
3,966,091 A * 6/1976 Bencic ..... B67D 1/005 222/129.1
3,980,233 A * 9/1976 Simmons ..... F23D 11/107 239/400
4,128,190 A * 12/1978 Gruber ..... B67D 1/005 137/607
4,538,921 A * 9/1985 Kennedy ..... B01F 5/0405 239/112
4,600,151 A * 7/1986 Bradley ..... F23D 11/107 239/400
4,708,266 A * 11/1987 Rudick ..... B67D 1/0036 222/105
4,753,370 A * 6/1988 Rudick ..... B67D 1/0051 222/105
4,946,105 A * 8/1990 Pane, Jr. ..... B05B 7/065 239/398
5,000,351 A * 3/1991 Rudick ..... B67D 1/0036 222/105
5,102,054 A * 4/1992 Halvorsen ..... B05B 7/065 123/531
5,251,655 A * 10/1993 Low ..... B67D 1/12 137/501
5,415,326 A * 5/1995 Durham ..... B67D 1/005 222/129.1
6,253,963 B1 * 7/2001 Tachibana ..... B67D 1/0044 222/129.1
8,528,786 B2 * 9/2013 Gates ..... B67D 7/74 222/1
9,388,033 B2 * 7/2016 Gates ..... B67D 1/0044
9,610,551 B2 * 4/2017 Erigican ..... B67D 1/1472
9,714,162 B2 * 7/2017 Hecht ..... B67D 1/0044
10,071,899 B2 * 9/2018 Mastro ..... B67D 1/0081
2017/0190554 A1 * 7/2017 Dahlberg ..... B67D 1/1272
2017/0349423 A1 * 12/2017 Hecht ..... B67D 1/0046

FOREIGN PATENT DOCUMENTS

GB 945826 A 1/1964
GB 2146413 A 4/1985
JP 2009-057053 A 3/2009

* cited by examiner

COCK FOR CARBONATED WATER

FIELD

The present invention relates to a carbonated water cock for dispensing carbonated water for beverage use.

BACKGROUND

Carbonated water servers mixing carbonated water with vodka, whiskey, or other distilled spirits or syrups or colas to provide carbonated alcoholic beverages or carbonated soft drinks are being widely used in restaurants etc. Carbonated water servers are usually provided with carbonated gas tanks, carbonation tanks storing carbonated water under pressure, bottles of distilled spirits or syrups etc. (below, referred to as "beverage base"), beverage base pumps, and carbonated water cocks which mix the carbonated water with the beverage base and dispense the beverage into glasses. The carbonation tank is supplied with relatively high pressure $CO_2$ gas for dissolving $CO_2$ gas in water to produce carbonated water. The $CO_2$ gas volume of the carbonated water is adjusted by the $CO_2$ gas pressure acting on the carbonation tank. The $CO_2$ gas volume of the carbonated water is highest at the carbonation tank and falls while passing through the carbonated water cock etc. and is lowest in the glass.

PTL 1 describes a hand draft type beverage dispenser for mixing carbonated water and a plurality of types of beverage bases to provide carbonated soft drinks at restaurants etc.

CITATION LIST

Patent Literature

[PTL 1] Japanese Unexamined Patent Publication No. 2009-57053

SUMMARY

Technical Problem

Lowering the pressure of the $CO_2$ gas acting on the carbonation tank would reduce the amount of consumption of the $CO_2$ gas and lead to a reduction of the capital cost of the carbonation tank. For this reason, it has been desired to lower the pressure of the $CO_2$ gas applied to the carbonation tank without lowering the $CO_2$ gas volume of the beverage dispensed into the glass.

The present invention is made in consideration of the above situation and has as its object the provision of a carbonated water cock in which the $CO_2$ gas volume is kept from dropping.

Solution to Problem

To achieve the above object, according to the present invention, there is provided a carbonated water cock receiving pressurized carbonated water and discharging it from a nozzle, the carbonated water cock comprising a first carbonated water flow path, a second carbonated water flow path connected to a downstream side of the first carbonated water flow path, extending in a direction different from the first carbonated water flow path, and exhibiting an annular-shaped flow path cross section, wherein an outer diameter of the flow path is larger than the first carbonated water flow path, but a flow path sectional area is smaller than the first carbonated water flow path, and a shaft defining an inner circumferential surface of the annular shape of the second carbonated water flow path, the shaft having a ring-shaped groove formed around an outer circumference of the shaft at a part of the second carbonated water flow path connected to the first carbonated water flow path, a longitudinal center axis of the first carbonated water flow path not being parallel to and not intersecting a longitudinal center axis of the second carbonated water flow path.

Advantageous Effects of Invention

Due to the configuration of the carbonated water cock according to the present invention, the carbonated water flowing in from the first carbonated water flow path to the second carbonated water flow path is changed in direction without rapidly being narrowed in flow path and without strongly striking the shaft. As a result, the drop in $CO_2$ gas volume of the carbonated water passing through the carbonated water cock is suppressed and therefore the pressure of the carbonation tank can be reduced by exactly an amount corresponding to the amount of drop suppressed.

DESCRIPTION OF EMBODIMENTS

Referring to FIG. 1 to FIG. 7, a carbonated water cock 10 according to an embodiment of the present invention will be explained below. First, referring to FIG. 1, a carbonated water server 100 provided with the carbonated water cock 10 according to an embodiment of the present invention will be explained.

Figure 1:
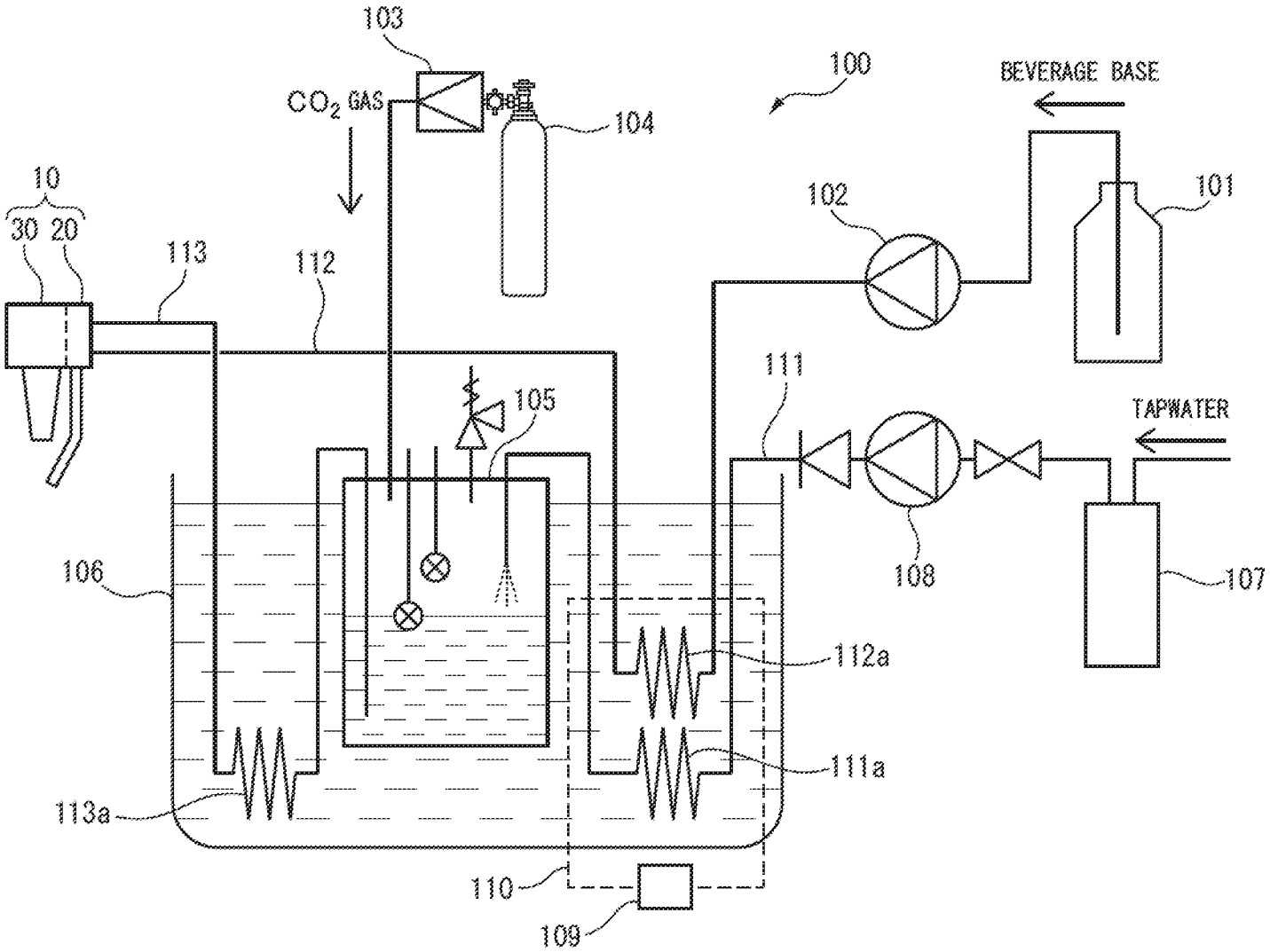
FIG. 1 is a view schematically showing the configuration of a carbonated water server provided with a carbonated water cock according to an embodiment of the present invention.

The carbonated water server 100 of FIG. 1 is a device for providing a carbonated alcoholic beverage obtained by mixing vodka or whiskey or other beverage base with carbonated water. The carbonated water server 100 may also be one providing a carbonated soft drink obtained using a syrup or cola etc. as a beverage base. The carbonated water server 100 of FIG. 1 is provided with a bottle 101 in which a beverage base is stored, a liquid pump 102 pumping the beverage base, a $CO_2$ gas tank 104 with a pressure regulator 103 attached, a carbonation tank 105 dissolving the $CO_2$ gas in water to produce carbonated water, a cooling water tank 106 cooling the carbonation tank 105, a high pressure pump 108 supplying tap water filtered by a water purifying filter 107 to the carbonation tank 105, a carbonated water cock 10 mixing the carbonated water and beverage base and dispensing the beverage into a glass etc., a cooling device 110 provided with a refrigerant compressor 109, etc. Supply pipelines 111, 112, 113 of the water, beverage base, and carbonated water are cooled at the cooling water tank 106 and have coil shaped parts 111*a*, 112*a*, 113*a* to improve the cooling efficiency.

In the carbonated water server 100 of FIG. 1, the carbonated water is pumped to the carbonated water cock 10 based on the pressure acting inside the carbonation tank 105. On the other hand, the beverage base is pumped by the liquid pump 102 to the carbonated water cock 10. The mixing ratio of the carbonated water and the beverage base is adjusted by adjusting the discharge pressure of the liquid pump 102. The $CO_2$ gas volume of the carbonated water is highest at the carbonation tank 105 and is lowest inside the glass (not shown) to which the beverage is dispensed from the carbonated water cock 10.

The carbonated water cock 10 is provided with a valve unit 20 for independently manually opening and closing the carbonated water flow path and beverage base flow path and a cock main body part 30 arranged downstream of the valve unit 20. The cock main body part 30 has a novel characterizing configuration enabling the drop in $CO_2$ gas volume to be suppressed, while the valve unit 20 is a known one having the above-mentioned function. For this reason, in the Description, further explanation of the valve unit 20 will be omitted and the cock main body part 30 will be explained in detail below.

Figure 2:
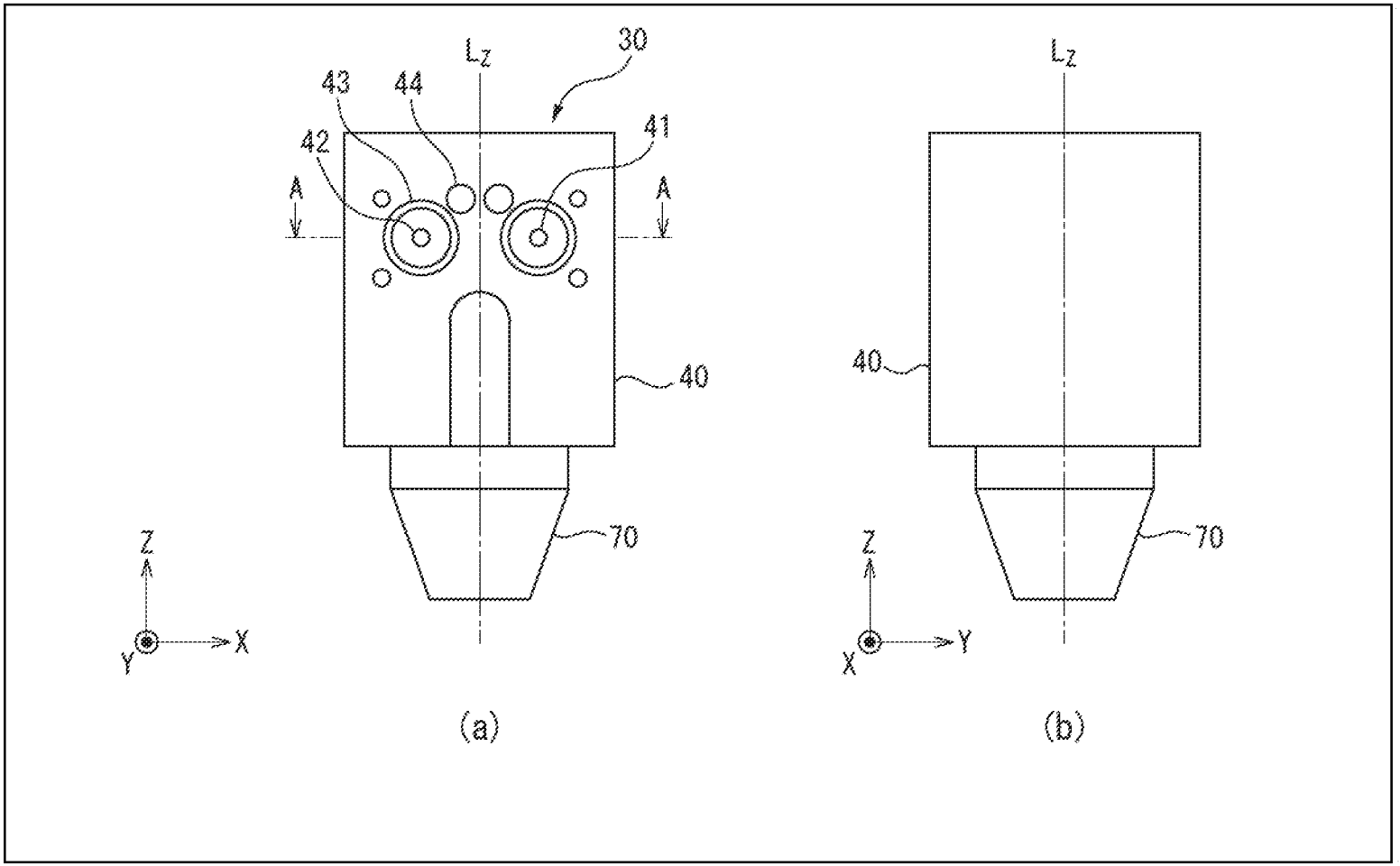
FIG. 2 is a view of the appearance of a cock main body part of a carbonated water cock according to an embodiment of the present invention, wherein (a) is a front view and (b) is a right side view.
Figure 3:
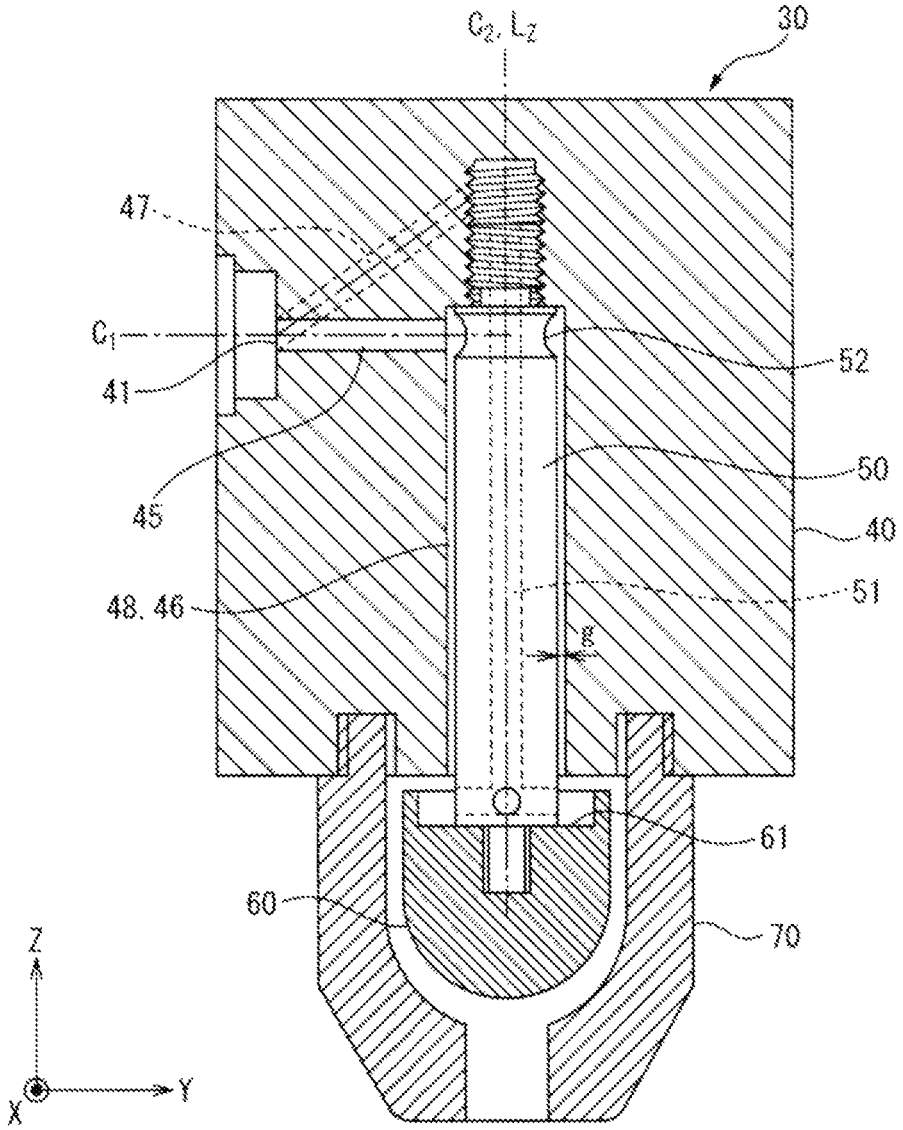
FIG. 3 is a side cross-sectional view of the cock main body part of FIG. 2.
Figure 4:
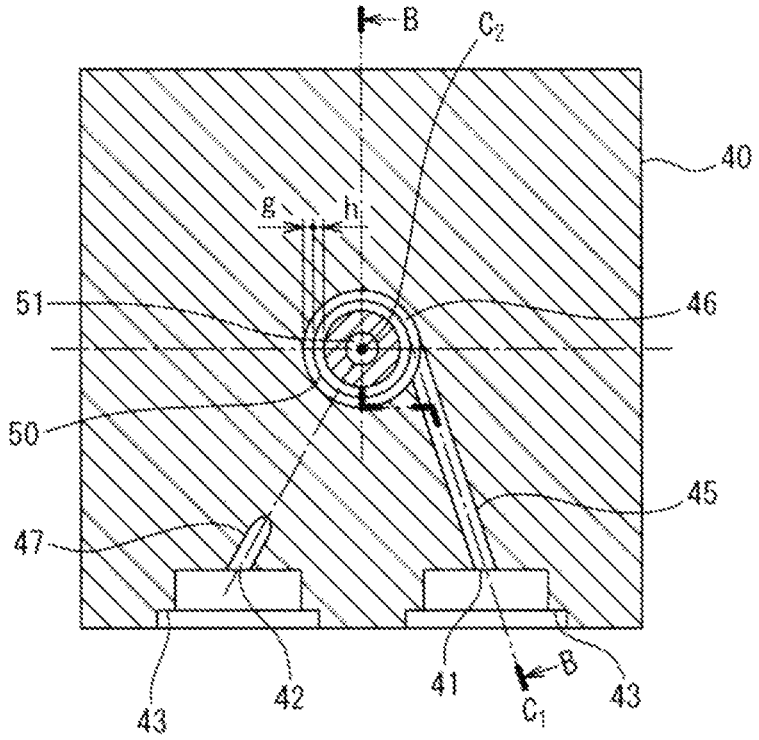
FIG. 4 is a cross-sectional view of the cock main body part of FIG. 2 and an A-A sectional view of (a) of FIG. 2.

FIG. 2 is a view showing the appearance of the cock main body part 30. In FIG. 2, (a) is a front view, while (b) is a right side view. In order to facilitate understanding of the explanation, orthogonal X-, Y-, and Z-axial directions are defined as shown in FIG. 2 and FIG. 3. FIG. 3 is a side sectional view cut so that the later explained first carbonated water flow path 45 and second carbonated water flow path 46 are revealed. FIG. 4 is an A-A sectional view of (a) of FIG. 2. The cock main body part 30 has a substantially parallelepiped block shaped main body 40, a shaft 50 arranged inside of the main body 40, a flow regulating member 60 attached to the bottom end of the shaft 50, and a nozzle 70 attached to the bottom surface of the main body 40. The main body 40, as shown in (a) of FIG. 2, has relatively small diameter carbonated water inlet 41 and beverage base inlet 42 provided substantially symmetrically across a center line $L_Z$ extending in the Z-direction. Around the carbonated water inlet 41 and the beverage base inlet 42, large diameter step-shaped recessed parts 43 are coaxially formed. Further, around the step-shaped recessed parts 43, a total of six holes 44 are formed. These step-shaped recessed parts 43 and holes 44 are provided for connection with the valve unit 20.

The main body 40 has a first carbonated water flow path 45 extending horizontally from the carbonated water inlet 41 to the inside, a second carbonated water flow path 46 connected to a downstream side of the first carbonated water flow path 45 and extending vertically downward, and a first beverage base flow path 47 extending from the beverage base inlet 42 to the inside upward at an incline. The second carbonated water flow path 46 is defined by an inner circumferential surface of a center hole 48 comprised of a blind hole bored upward from the bottom part coaxially with the center line $L_Z$ of the main body 40 and by the outer circumferential surface of the shaft 50 of a smaller diameter than the center hole 48, which shaft 50 is fastened by being screwed into the center hole 48 coaxially. In other words, the second carbonated water flow path 46 is formed as an annular gap "g" between the outer circumferential surface of the shaft 50 and the inner circumferential surface of the center hole 48. In the present embodiment, the diameter of the first carbonated water flow path 45 is 3.5 mm, while the outer diameter of the second carbonated water flow path 46 is 11.1 mm or about 3 times larger.

However, in terms of flow path sectional area, conversely the second carbonated water flow path 46 is about 40% of the first carbonated water flow path 45.

In this regard, it is known that if the flow of a fluid in which a gas is dissolved becomes turbulent, a drop in the gas volume will be invited. Therefore, the shapes and flow path sectional areas of the first carbonated water flow path 45 and second carbonated water flow path 46 in the present embodiment explained above are set conditional on maintenance of a predetermined flow rate of supply while maintaining the flows inside the flow paths as laminar flows.

The first beverage base flow path 47 extends from the beverage base inlet 42 upward at an incline so as to connect the inlet 42 and the outlet of the first beverage base flow path 47 formed at the inner circumferential surface near the top end part of the shaft-use screw hole of the main body 40. On the other hand, the shaft 50 has the second beverage base flow path 51 as a hole formed along its center axis. The inlet of the second beverage base flow path 51 is provided at the top end face of the shaft 50. The second beverage base flow path 51 extends along the center axis of the shaft 50 from the top end downward and has four outlets branched radially at the outer circumferential surface near the bottom end. Note that, the center axis of the shaft 50, the center axis $L_Z$ of the main body 40, and the longitudinal center axes $C_2$ of the second carbonated water flow path 46 match in the present embodiment.

At the bottom end of the shaft 50, the flow regulating member 60 is screwed in to fasten it. The flow regulating member 60 is formed into a columnar shape having a semispherical front end. A circular recessed part 61 is formed at the inside of the top end part. The circular recessed part 61 has a diameter larger than the outer diameter of the second carbonated water flow path 46, so it is possible to receive the carbonated water flowing down along the second carbonated water flow path 46 and mix it with the beverage base flowing out from the outlet of the second beverage base flow path 51 provided at the shaft 50.

The nozzle 70 has inside it a space able to house the flow regulating member 60 and is fastened by being screwed into the bottom surface of the main body 40 in a state surrounding the flow regulating member 60. The carbonated water and beverage base mixed inside the flow regulating member 60 pass through the gap between the top end face of the flow regulating member 60 and the bottom surface of the main body 40 to flow into the space in the nozzle 70 and are discharged from there downward.

Next, the state of connection of the first carbonated water flow path 45 and the second carbonated water flow path 46 will be explained in more detail. The longitudinal center axis $C_1$ of the first carbonated water flow path 45 and the longitudinal center axis $C_2$ of the second carbonated water flow path 46 vertically intersect when viewed in the X-direction (FIG. 3), but do not intersect if viewed in the Z-direction (FIG. 4). In particular, in the present embodiment, as shown in FIG. 4, the first carbonated water flow path 45 and the second carbonated water flow path 46 are connected so that among two lines showing a contour of the first carbonated water flow path 45, the line further from the longitudinal center axis $C_2$ of the second carbonated water flow path 46 is a tangent of a circle showing the outer diameter of the second carbonated water flow path 46.

Figure 5:
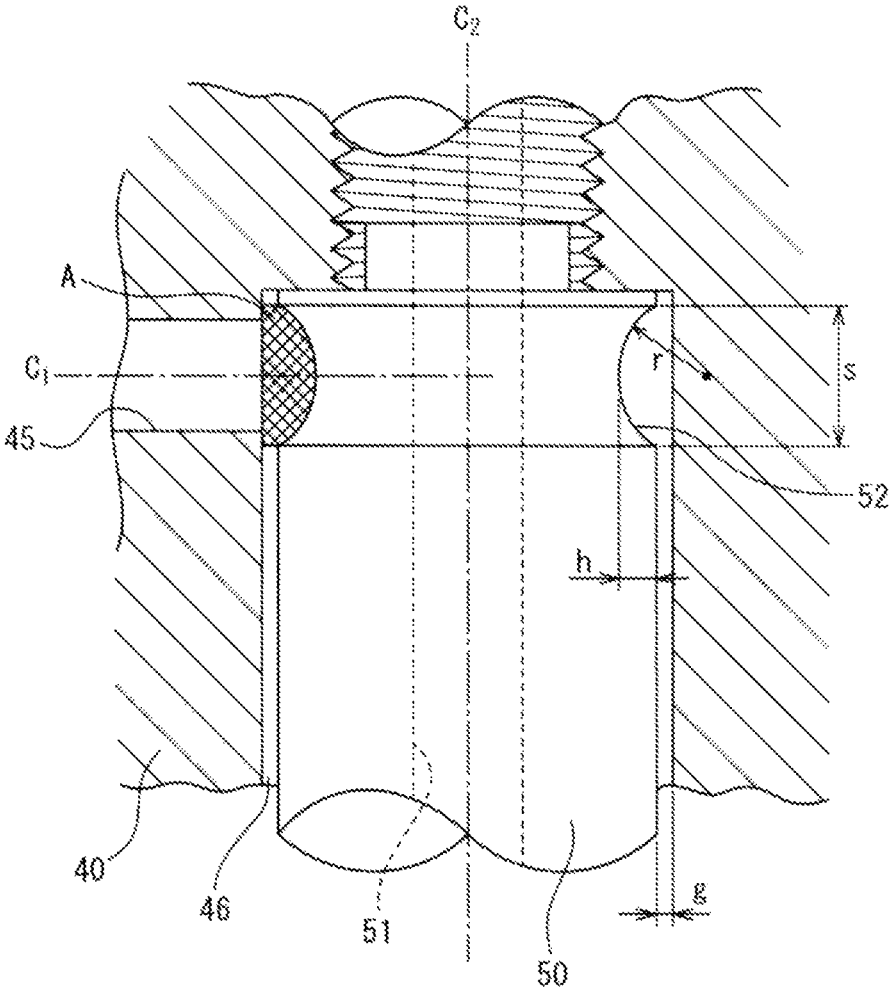
FIG. 5 is an enlarged view of part of a ring-shaped groove of a shaft in FIG. 3.

The shaft 50 has a ring-shaped groove 52 formed around the outer circumference of the shaft 50 at the part of the second carbonated water flow path 46 connected to the first carbonated water flow path 45, in other words, the part where the longitudinal center axis $C_1$ of the first carbonated water flow path 45 intersects when viewed from the side in the X-direction. The ring-shaped groove 52 has a bow shaped cross-section. In the present embodiment, the dimensions of the bow shape are set as a radius "r" of 2.5 mm, a chord "s" of 4 mm, and a height "h" of the arc of 1 mm. Further, the gap "g" between the outer circumferential surface of the shaft 50 and the inner circumferential surface of the center hole 48 of the main body 40, that is, the width "g" of the second carbonated water flow path 46, is 0.1 mm. As shown in FIG. 5, the area of the hatched region A comprised of the bow shaped area of the ring-shaped groove 52 when viewed from the side plus the area of the rectangular shape formed by the chord "s" of the bow shape and the width "g" of the second carbonated water flow path is, in the present embodiment, 3.2 $mm^2$. This is 33% of the flow path sectional area of the first carbonated water flow path 45.

As explained above, by the first carbonated water flow path 45 being connected to the second carbonated water flow path 46 in the tangential direction and by the ring-shaped groove 52 being formed on the shaft 50 on the extension of the first carbonated water flow path 45, the carbonated water flowing in from the horizontally extending first carbonated water flow path 45 to the vertically downward extending second carbonated water flow path 46 is changed in direction from the horizontal direction to downward without the flow path being rapidly narrowed and without the shaft 50 being strongly struck. As a result, the $CO_2$ gas volume of the carbonated water is kept from dropping.

Figure 6:
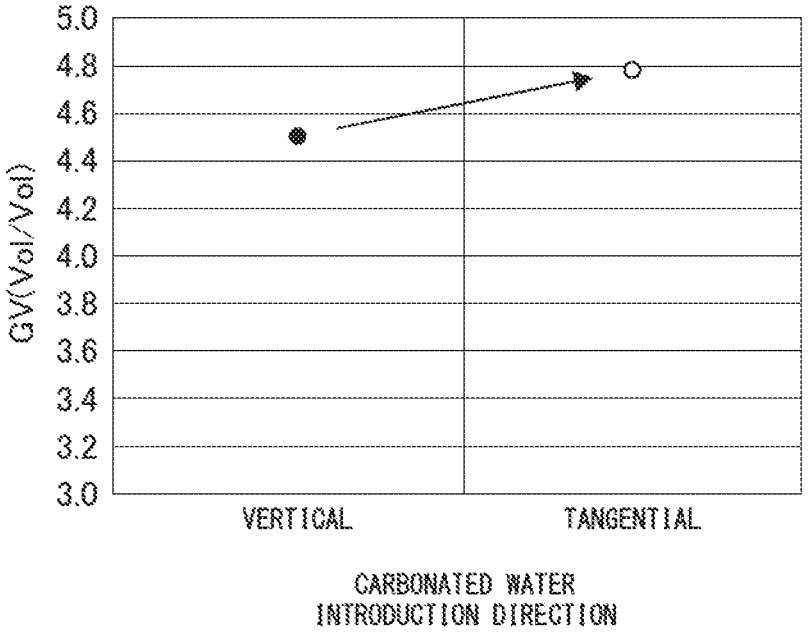
FIG. 6 is a view showing measured values of the $CO_2$ gas volume.

In actuality, regarding the $CO_2$ gas volume of the discharged carbonated water, if comparing by actually measured values the carbonated water cock 10 of the present embodiment in which the first carbonated water flow path 45 is connected to the second carbonated water flow path 46 in the tangential direction and a first comparison-use carbonated water cock (not shown) in which the shaft 50 has a ring-shaped groove 52, but the longitudinal center axes $C_1$, $C_2$ of the first carbonated water flow path 45 and the second carbonated water flow path 46 intersect when viewed in the Z-direction, as shown in FIG. 6, the volume is 4.5V/V in the case of the first comparison-use carbonated water cock, while is 4.8V/V in the case of the carbonated water cock 10 of the present embodiment. It is learned that there is an approximately 7% improvement.

Figure 7:
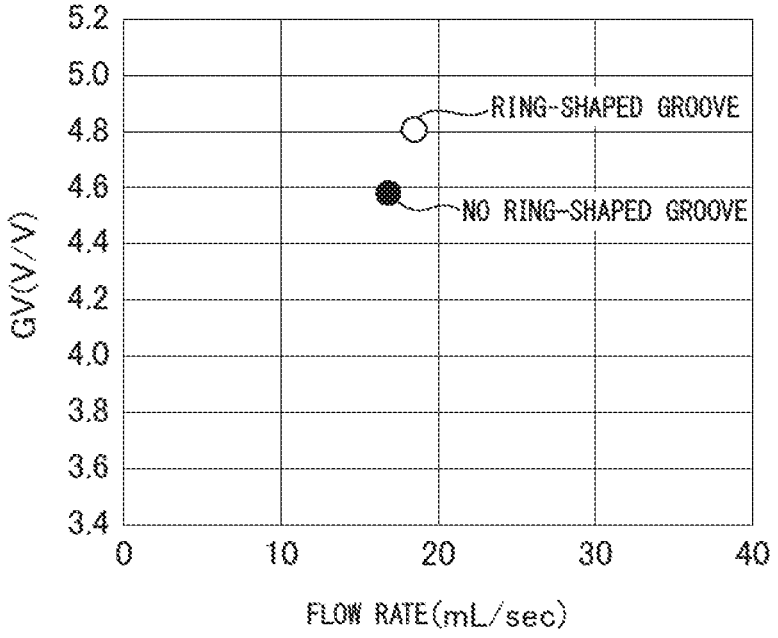
FIG. 7 is a view showing measured values of the $CO_2$ gas volume.

Further, a second comparison-use carbonated water cock (not shown) in which the first carbonated water flow path 45 is connected to the second carbonated water flow path 46 in the tangential direction, but there is no bow shaped ring-shaped groove 52 and the carbonated water cock 10 of the present embodiment are compared. The results (measured values) are shown in FIG. 7. As shown in FIG. 7, the $CO_2$ gas volume of carbonated water is about 4.6 V/V in the case of the second comparison use carbonated water cock, while it is 4.8V/V in the case of the carbonated water cock 10 of the present embodiment. It is learned that there is an approximately 4% improvement.

The depth of the ring-shaped groove 52 with a bow shape or the height "h" of the arc is set to 1 mm in the embodiment shown in FIG. 5, but if too deep, the free space increases and thereby turbulence is caused and a drop in the gas volume is invited. The upper limit value of the depth of the ring-shaped groove 52 for not allowing turbulence can be found from computer simulation. The result is 1.5 mm. The area of the region A of FIG. 5 when the depth of the ring-shaped groove 52 is 1.5 mm is 50% of the flow cross-sectional area of the first carbonated water flow path 45.

On the other hand, the shallower the depth of the ring-shaped groove 52 from the optimum value, gradually the more the $CO_2$ gas volume of the carbonated water drops, but compared with the case of no ring-shaped groove 52 at all, the existence of the advantageous effect even with a shallow ring-shaped groove 52 can be understood from the measurement results shown in FIG. 7.

In the present embodiment, as shown in FIG. 4, when viewed in the Z-axial direction, the first carbonated water flow path 45 is connected to the second carbonated water flow path 46 in the tangential direction, but so long as the longitudinal center axis $C_1$ of the first carbonated water flow path 45 is close to the longitudinal center axis $C_2$ of the second carbonated water flow path 46 but does not intersect it, while not to the extent of the case of the above embodiment, the existence of the advantageous effect of the present invention can be understood from the measurement results shown in FIG. 6.

In the present embodiment, the longitudinal center axis $C_1$ of the first carbonated water flow path 45 and the longitudinal center axis $C_2$ of the second carbonated water flow path 46 perpendicularly intersect when seen from the side, but an embodiment in which the angle of intersection is other than a perpendicular one is also possible in the present invention.

Summarizing the relationship between the above-mentioned longitudinal center axes $C_1$ and $C_2$, in the present invention, an embodiment in which the respective longitudinal center axes $C_1$, $C_2$ of the first carbonated water flow path 45 and second carbonated water flow path 46 are not parallel to each other and do not intersect becomes possible.

In the above-mentioned embodiment, just one type of beverage base is supplied to the carbonated water cock 10, but an embodiment of a carbonated water cock to which a plurality of types of beverage bases are supplied is also possible in the present invention. Further, conversely, an embodiment in which no beverage base is supplied and in which only carbonated water is supplied is also possible in the present invention.

REFERENCE SIGNS LIST

10 carbonated water cock
30 cock main body part
40 main body
41 carbonated water inlet
42 beverage base inlet
45 first carbonated water flow path
46 second carbonated water flow path
50 shaft
52 ring-shaped groove
60 flow regulating member
70 nozzle
$C_1$ longitudinal center axis of first carbonated water flow path
$C_2$ longitudinal center axis of second carbonated water flow path

The invention claimed is:

1. A carbonated water cock receiving pressurized carbonated water and discharging the pressurized carbonated water from a nozzle, the carbonated water cock comprising:

a body:

a shaft;

a first carbonated water flow path formed in the body: and a second carbonated water flow path connected to a downstream side of the first carbonated water flow path, the second carbonated water flow path extending in a direction different from the first carbonated water flow path, the second carbonated water flow path exhibiting an annular-shaped flow path cross section, wherein an outer diameter of the second carbonated water flow path is larger than an outer diameter of the first carbonated water flow path, but a sectional area of the second carbonated water flow path perpendicular to a direction of flow is smaller than a sectional area of the first carbonated water flow path perpendicular to a direction of flow; and a longitudinal center axis of the first carbonated water flow path not being parallel to a longitudinal center axis of the second carbonated water flow path, wherein the body has a bore configured to form the second carbonated water flow path between the bore and the shaft fixed to the body within the bore, wherein the shaft has a ring-shaped groove formed around an outer circumference of the shaft at a part of the second carbonated water flow path that is connected to the first carbonated water flow path, wherein the first carbonated water flow path and the second carbonated water flow path are connected so that among two lines defining a contour of the first carbonated water flow path, a line further from the center axis of the second carbonated water flow path is a tangent of a circle defining a contour of an outside of the annular shape of the second carbonated water flow path, and wherein a sectional shape of the ring-shaped groove of the shaft is a bow shape and a total area of an area of the bow shape and an area of a rectangle formed by a chord of the bow shape and a width of the second carbonated water flow path is less than 50% of the flow path sectional area of the first carbonated water flow path.

2. The carbonated water cock according to claim 1, wherein the total area of the area of the bow shape and the area of the rectangle formed by the chord of the bow shape and the width of the second carbonated water flow path is 33% of the flow path sectional area of the first carbonated water flow path.

* * * * *